US012065890B2

(12) United States Patent
Ramsauer et al.

(10) Patent No.: US 12,065,890 B2
(45) Date of Patent: Aug. 20, 2024

(54) DEVICE FOR TRANSFERRING DATA AND/OR POWER IN A DERRICK OR IN A WORKOVER RIG

(71) Applicant: THINK AND VISION GMBH, Leoben (AT)

(72) Inventors: Medardus Ramsauer, Kuchl (AT); Abdelrhani Lamik, Leoben (AT); Anton Kotov, Samara (RU)

(73) Assignee: THINK AND VISION GMBH, Leoben (AT)

( * ) Notice: Subject to any disclaimer, the term of this patent is extended or adjusted under 35 U.S.C. 154(b) by 50 days.

(21) Appl. No.: 17/921,062

(22) PCT Filed: Apr. 6, 2021

(86) PCT No.: PCT/EP2021/058942

§ 371 (c)(1),
(2) Date: Oct. 24, 2022

(87) PCT Pub. No.: WO2021/213798

PCT Pub. Date: Oct. 28, 2021

(65) Prior Publication Data

US 2023/0175324 A1 Jun. 8, 2023

(30) Foreign Application Priority Data

Apr. 25, 2020 (AT) ..... A 100/2020

(51) Int. Cl.
*E21B 17/02* (2006.01)
*E21B 3/02* (2006.01)
(Continued)

(52) U.S. Cl.
CPC ..... *E21B 17/028* (2013.01); *E21B 17/03* (2013.01); *E21B 47/12* (2013.01); *E21B 3/022* (2020.05)

(58) Field of Classification Search
CPC ..... E21B 17/028; E21B 17/03; E21B 3/022; E21B 47/12
See application file for complete search history.

(56) References Cited

U.S. PATENT DOCUMENTS

2010/0200295 A1* 8/2010 Schimanski ..... E21B 7/062 175/45
2011/0280104 A1* 11/2011 McClung, III ..... E21B 3/022 175/170

(Continued)

FOREIGN PATENT DOCUMENTS

CN 105932507 9/2016
DE 198 19 626 4/1999

(Continued)

OTHER PUBLICATIONS

Jenne, et al., German Patent No. DE 102014104552-A1. English translation date Feb. 5, 2024. (Year: 2024).*

(Continued)

*Primary Examiner* — Caroline N Butcher
(74) *Attorney, Agent, or Firm* — NIXON & VANDERHYE

(57) ABSTRACT

A device for transmitting data and/or power from a rotating part, for example a pipe handler, to a non-rotating part, for example a top drive, of a drilling rig or a workover rig has at least one slip ring with at least one sliding contact in contact therewith. The device includes a first ring and a second ring. The first ring and the second ring delimit a closed area. The slip ring(s) and the sliding contact(s) is/are arranged within the closed area.

17 Claims, 5 Drawing Sheets

(51) Int. Cl.
*E21B 17/03* (2006.01)
*E21B 47/12* (2012.01)

(56) References Cited

U.S. PATENT DOCUMENTS

| | | | | |
|---|---|---|---|---|
| 2014/0144651 | A1* | 5/2014 | Lamik-Thonhauser | E21B 17/028 166/65.1 |
| 2018/0016853 | A1* | 1/2018 | Richardson | E21B 19/16 |
| 2018/0073306 | A1 | 3/2018 | Verhoef et al. | |
| 2020/0115969 | A1* | 4/2020 | De Mul | E21B 19/00 |

FOREIGN PATENT DOCUMENTS

| | | | | |
|---|---|---|---|---|
| DE | 10 2014 104 552 | | 10/2015 | |
| DE | 102014104552 | A1 * | 10/2015 | E21B 17/028 |
| EP | 2 390 499 | | 11/2011 | |
| EP | 2 738 346 | | 6/2014 | |
| WO | 2010/141969 | | 12/2010 | |

OTHER PUBLICATIONS

International Search Report and Written Opinion of the ISA for PCT/EP2021/058942 dated Jun. 10, 2021, 12 pages.

* cited by examiner

DEVICE FOR TRANSFERRING DATA AND/OR POWER IN A DERRICK OR IN A WORKOVER RIG

CROSS-REFERENCE TO RELATED APPLICATIONS

This application is the U.S. national phase of International Application No. PCT/EP2021/058942 filed Apr. 6, 2021 which designated the U.S. and claims priority to AT Patent Application No. A 100/2020 filed Apr. 25, 2020, the entire contents of each of which are hereby incorporated by reference.

BACKGROUND OF THE INVENTION

Field of the Invention

The invention relates to a device for transmitting data and/or power from a rotatable to a rotationally fixed part of a drilling rig or workover rig using an electric cable.

The invention further relates to a top drive system of a drilling installation, in which a top drive is mounted on a vertical guide of a tower of the drilling installation in a rotationally fixed manner via a carriage and movable in the vertical direction, wherein a pipe handler is mounted on the top drive via an adapter having an axis of rotation, wherein the pipe handler is rotatable relative to the top drive about the axis of rotation, and wherein the top drive is connected to system devices or controls of the drilling installation on the surface via an electrical data and/or power line.

Description of the Related Art

Drilling rigs are used, for example, to drill for oil, natural gas, geothermal energy or water. Such drilling rigs usually have a tower on which a top drive is mounted on a vertical guide of the tower by means of a carriage so that it cannot rotate but can move in the vertical direction. The drill string, at the lower end of which the drill head or drill bit is located, is mounted on this top drive. The drill string consists of a large number of drill pipes, with further drill pipes being successively bolted to the upper end of the drill string as the depth of the borehole increases. The uppermost drill pipe in each case is connected to a drive shaft of the top drive. The uppermost drill pipe can be screwed to the drive shaft for this purpose. Drive motors in the top drive drive the drive shaft, which in turn rotationally drives the drill string with the drill head.

For mounting or screwing an additional drill pipe to the drive shaft, a device usually referred to as a "pipe handler" is used, which can be pivoted out of the axis of rotation relative to the top drive and rotated about the axis of rotation on an adapter via which the pipe handler is mounted on the top drive. With the pipe handler, another drill pipe to be screwed to the drill string is gripped, brought up to the drive shaft, held during mounting on or screwing to the drive shaft and, if necessary, also rotated relative to the top drive. When dismantling a drill pipe, the pipe handler is used in the same way, but in reverse order.

Workover rigs are used for maintenance work on existing recovery or extraction systems, for example to carry out maintenance or repairs. They can also have a rotationally fixed part and a rotating part, between which data and/or power transmission should be possible.

An essential element in modern oil, gas and geothermal drilling is data acquisition during the drilling process. Furthermore, it is of great advantage if electrical consumers in the drill string and/or in the drill head can be permanently supplied with power through the drill string. A possibility to establish a galvanic connection between the individual drill pipes, with which both a data transmission and a power supply with high performance is possible is known for example from WO 2010/141969 A. However, efficient power and/or data transmission requires that the drill string is also galvanically or inductively connected to the corresponding system equipment or controls of the drilling installation at the surface.

For the transmission of data between the top drive and the pipe handler, it is known to use cable connections. However, it is troubling that the connecting cable between the top drive and pipe handler which has a certain, but limited, excess length can be torn off when the pipe handler rotates. The known connecting cables have a predetermined breaking point at which a torn cable can be reconnected, but on the one hand the operator is hindered because he has to pay constant attention to the connecting cable, and on the other hand a disconnected connecting cable represents a disruption in the operating sequence if it has to be reconnected.

SUMMARY OF THE INVENTION

It is therefore an object of the invention to provide a device of the type mentioned at the beginning, in which the disadvantages occurring in the prior art are eliminated. In particular, the device according to the invention is intended to eliminate the risk of damage to or destruction of the connecting cable between the rotatable pipe handler and the rotationally fixed top drive.

This object is achieved with a device and also with a top drive system having the features disclosed herein.

By means of the two rings, which are essentially similar to a slip ring construction known per se, a connection can be established which is no longer limited in terms of the angle of rotation. Since particularly strict regulations regarding explosion safety apply to drilling installation due to the high risk of explosion, the design of the slip ring construction with two rings closed in the circumferential direction can create a completely sealed contacting area between the slip ring(s) and the sliding contact(s), while at the same time the slip ring(s) is/are also permanently sealed or isolated from the environment.

The device according to the invention preferably has at least two slip rings with associated sliding contacts, which are accommodated in the closed area formed by the rings. However, embodiments in which the device has only one single slip ring with associated sliding contact arranged in the closed area are also possible within the scope of the invention. If the device according to the invention is used in the embodiment with only one slip ring with sliding contact for the transmission of electric current, the return of the current must be safely ensured in another way (e.g. via the housing or via the bearings of the slip ring).

In the following description, only embodiments in which the device according to the invention has two slip rings with associated sliding contacts will be discussed in more detail. However, in the sense of the present invention, all these embodiments can also be designed with only one slip ring with associated sliding contact.

Further preferred embodiments of the invention are disclosed.

According to the invention, a particularly useful embodiment is characterized in that the first ring has a circumferential groove, in that the second ring is at least partially accommodated in the groove of the first ring, and in that the slip rings and the sliding contacts are arranged within the groove on the first ring or on the second ring, respectively. The groove defines a largely closed-off area which can be closed off the outside in a simple manner by the second ring.

Although it is preferred in the invention that at least two slip rings and sliding contacts are disposed on opposite sides of the second ring, it is equally possible that at least two slip rings and sliding contacts are disposed substantially side by side. Combinations of side-by-side and opposing slip rings and sliding contacts are also possible within the scope of the invention.

Similarly, it is preferred in the invention that the slip rings be disposed on the second ring and the sliding contacts be disposed on the first ring, although it is of course also possible for the slip rings to be disposed on the first ring and the sliding contacts to be disposed on the second ring.

BRIEF DESCRIPTION OF THE DRAWINGS

Further features and advantages of the invention result from the following description of a preferred embodiment of the invention, which does not limit the scope of protection, with reference to the attached drawings. It shows.

DESCRIPTION OF THE PREFERRED EMBODIMENTS

Figure 1:
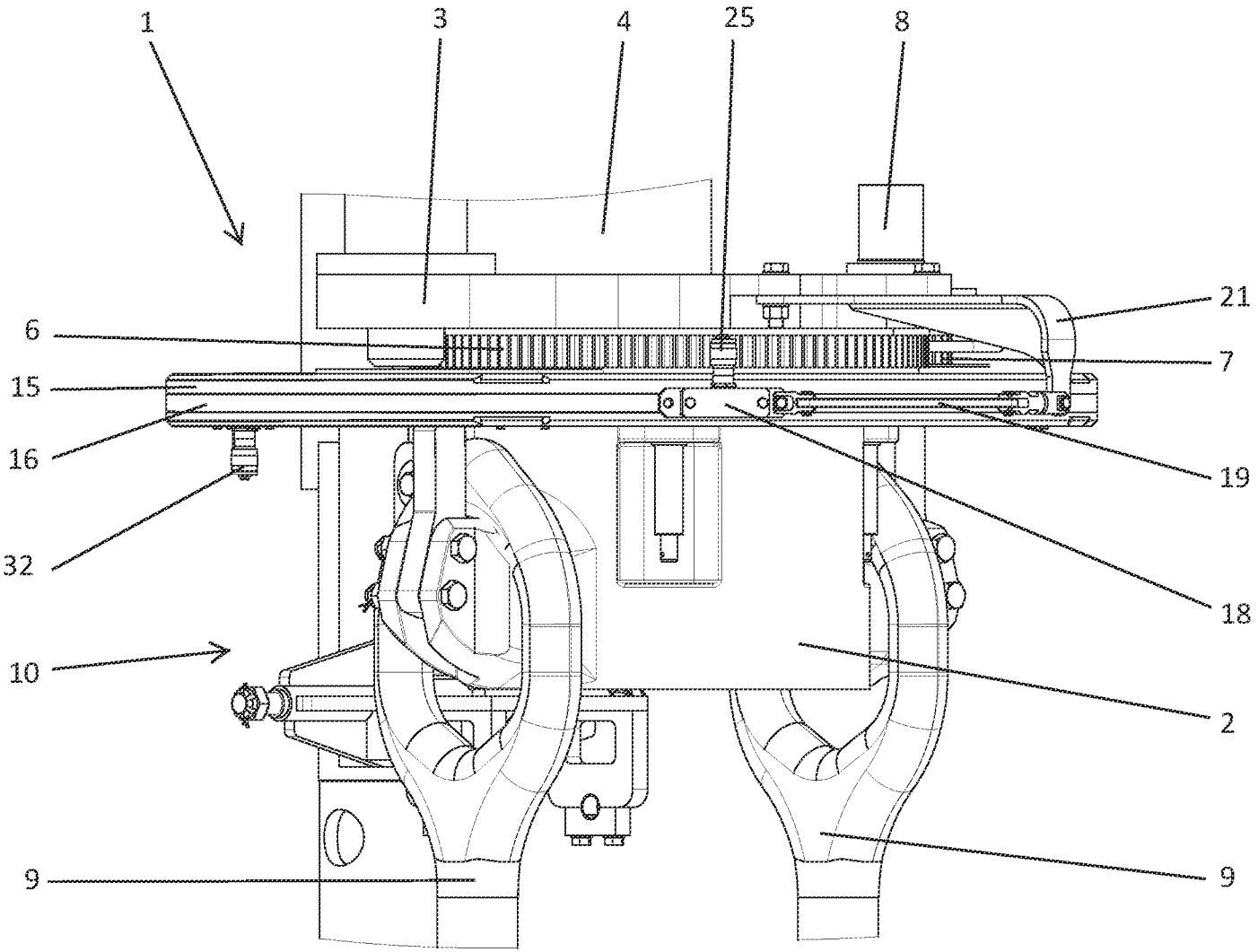
FIG. 1 a side view of the device according to the invention.

In the drawings, an embodiment of a device according to the invention is shown, which is, however, only exemplary and, apart from the features according to the invention as defined in the claims, can also be designed differently within the scope of the present invention with respect to many components, without this requiring special mention in the following. In particular, the device according to the invention may comprise only one slip ring with an associated sliding contact.

Figure 2:
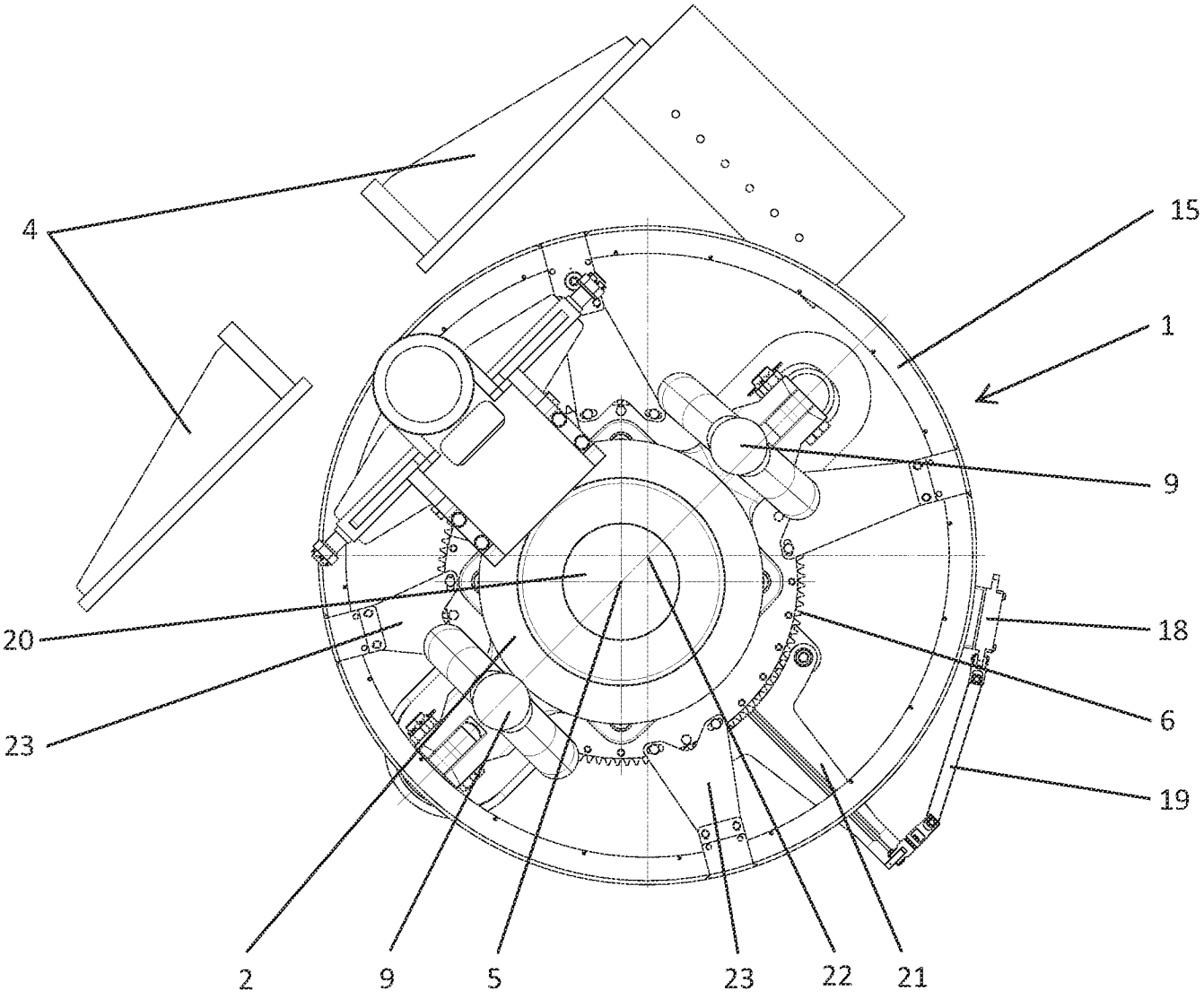
FIG. 2 a view of the device according to the invention of FIG. 1 from below, FIG. 3 an inner ring of the device according to the invention, FIG. 4 an outer ring of the device according to the invention, FIG. 5 a section through the inner and outer ring in the area of an electrical connection to the inner ring, FIG. 6 a section through the inner and outer ring in the area of an electrical connection to the outer ring, and FIG. 7 a section through the inner and outer ring between the connections to the inner and outer ring.
Figure 3:
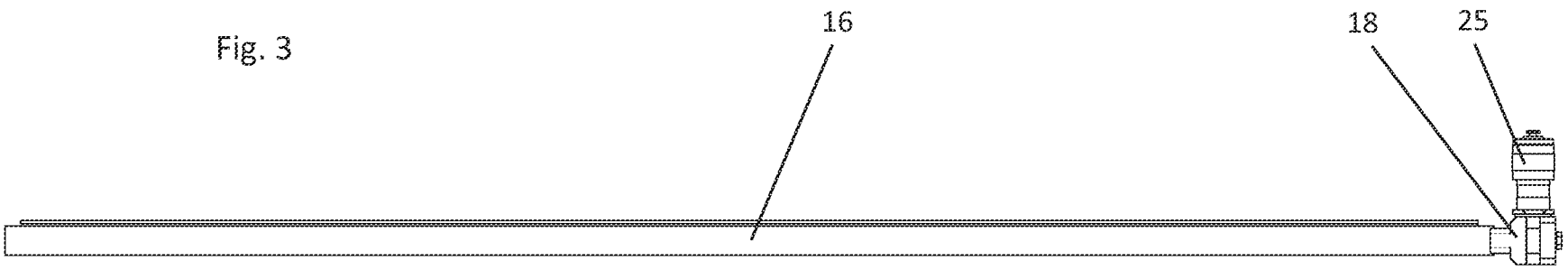
Figure 4:
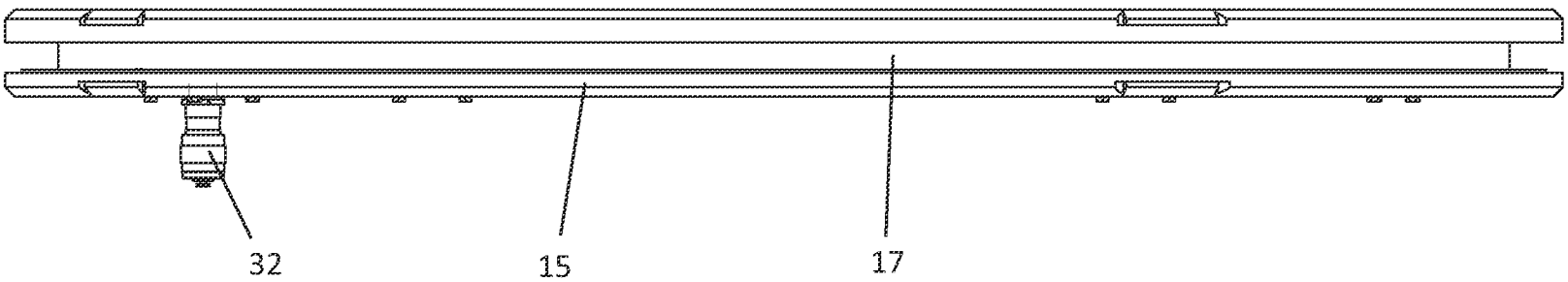

FIGS. 1 and 2 show a device 1 according to the invention in the area of an adapter 2, via which a rotating part of a top drive system not specifically shown—in the embodiment shown, a pipe handler 10—is arranged on a rotationally fixed part of the top drive system—in the embodiment shown, a top drive 3. The top drive 3 is mounted displaceable on a vertical guide 4, which is only shown in fragments in FIGS. 1 and 2, via a carriage, which is not shown, on a tower of a drilling installation, which is also not shown.

On the adapter 2 of the pipe handler 10, rod-shaped links 9 are pivotably mounted at one end so that they can be pivoted out of an axis of rotation 5 of the pipe handler 10. Grippers or clamps are mounted on the other ends, which are not shown, of the rod-shaped links 9, with which drill pipes can be gripped and connected to a drive shaft of the top drive 3, which is arranged in the area between the links 9 and is not shown.

The adapter 2 together with the links 9 can be rotated about the axis of rotation 5 relative to the rotationally fixed part—i.e. the top drive 3—of the top drive system and for this purpose has a spur gear 6 in the area of the connection to the top drive 3, in which a pinion 7 of a drive 8 mounted on the rotationally fixed top drive 3 engages. The drive shaft, which can be driven by drive motors in the top drive, is guided through a bore 20 in the adapter 2 which is coaxial with the axis of rotation 5. As far as described so far, the device is designed as sufficiently known from the prior art.

In order to establish a cable connection from the pipe handler 10, which in turn can be galvanically or inductively connected to electrical conductors in the connected drill pipe of the drill string, to the rotationally fixed top drive 3, slip rings 11, 12 with sliding contacts 13, 14 are provided according to the invention. In the embodiment shown, the sliding contacts 13, 14 are arranged on a first ring closed in the circumferential direction, a so-called outer ring 15. The slip rings 11, 12 are arranged on a second ring, also closed in the circumferential direction, a so-called inner ring 16. In the context of the invention, the terms outer ring 15 and inner ring 16 do not mean that the inner ring 16 must be arranged radially inside the outer ring 15, although this is not excluded, but that the inner ring 16 is at least partially accommodated in a groove 17 of the outer ring 15. In the embodiment shown, the groove 17 of the outer ring 15 is directed radially outwardly, although this need not necessarily be so. An orientation of the groove 17 in another direction, for example downwards in the installation position, would also be possible.

In the embodiment shown, the outer ring 15 is mounted via spokes 23 on the adapter 2, specifically on the spur gear 6, which is attached to the adapter 2, so that it cannot rotate. The sliding contacts 13, 14 rotate accordingly with the adapter 2. The inner ring is mounted on the rotationally fixed top drive 3 via a holder 18, a pivot arm 19 and a support arm 21. The slip rings 11, 12 are accordingly mounted in a rotationally fixed manner.

The outer ring 15 and the inner ring 16 have a common, central axis 22 around which the outer ring 15 rotates. The axis 22 of the outer ring 15 and the inner ring 16 is slightly offset from the axis of rotation 5 of the adapter 2, as can be seen in FIG. 2. This enables a particularly compact design of the top drive system.

Since the axis 22 of the two rings 15, 16 is offset with respect to the axis of rotation 5 of the adapter 2 of the pipe handler 10, i.e. lies parallel to it, the radial distance of the holder 18 of the inner ring 16 from the axis of rotation 5 of the pipe handler 10 changes when the pipe handler 10 is rotated. In order to be able to compensate for this change, the pivot arm 19 is provided, which is connected to both the holder 18 and the support arm 21 via a joint in each case.

Figure 7:
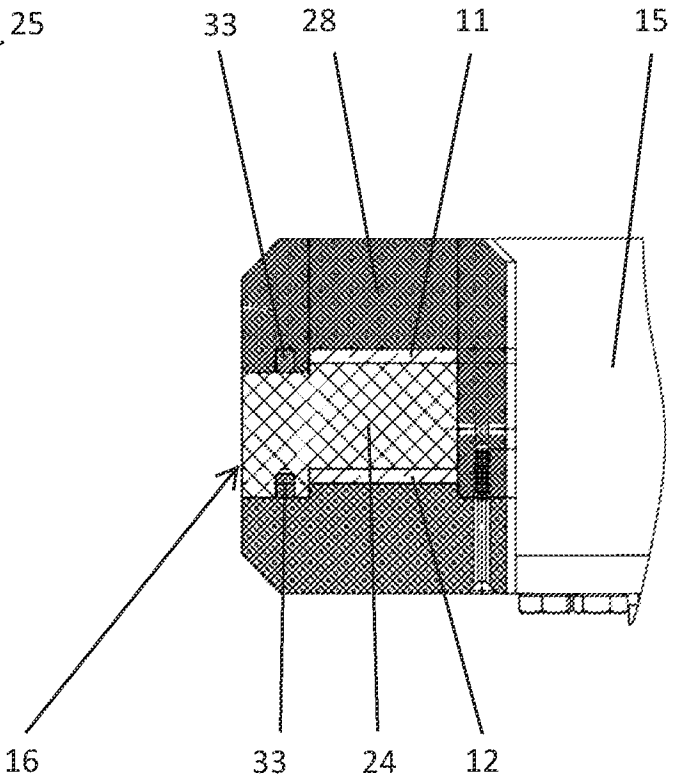
Figure 5:
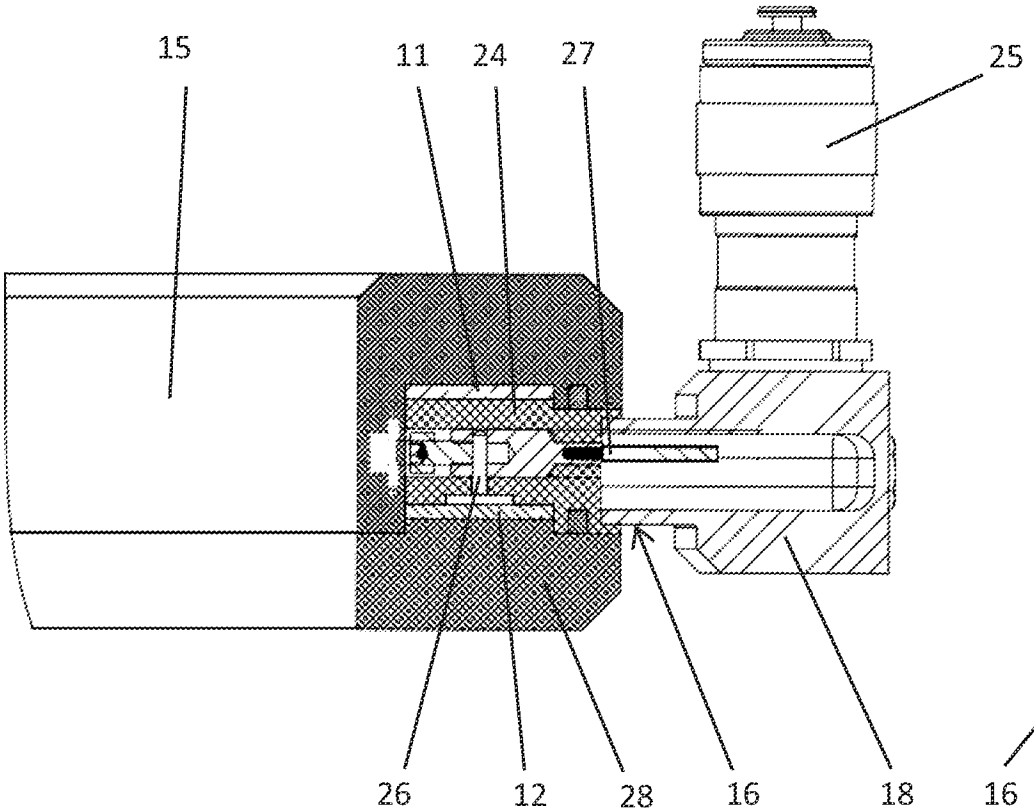

As shown in FIGS. 5 and 7, the slip rings 11, 12 are annularly disk-shaped and flat and arranged on opposite sides of an electrical insulating body 24 of the inner ring 16. To connect the two slip rings 11, 12 to a plug 25, pins 26 connected to the slip rings 11, 12 are provided which establish a galvanic connection to conductors 27 leading to corresponding contacts in the plug 25. A line can be plugged into the plug 25 which is connected to system equipment or controls of the drilling installation at the surface. In FIG. 5, only the pin 26 and the conductor 27 are shown, which are connected to the lower slip ring 12. However, a corresponding connection arranged in mirror-image provided for the upper slip ring 11 is not shown in FIG. 5 because it is offset in the circumferential direction of the rings 15, 16.

Figure 6:
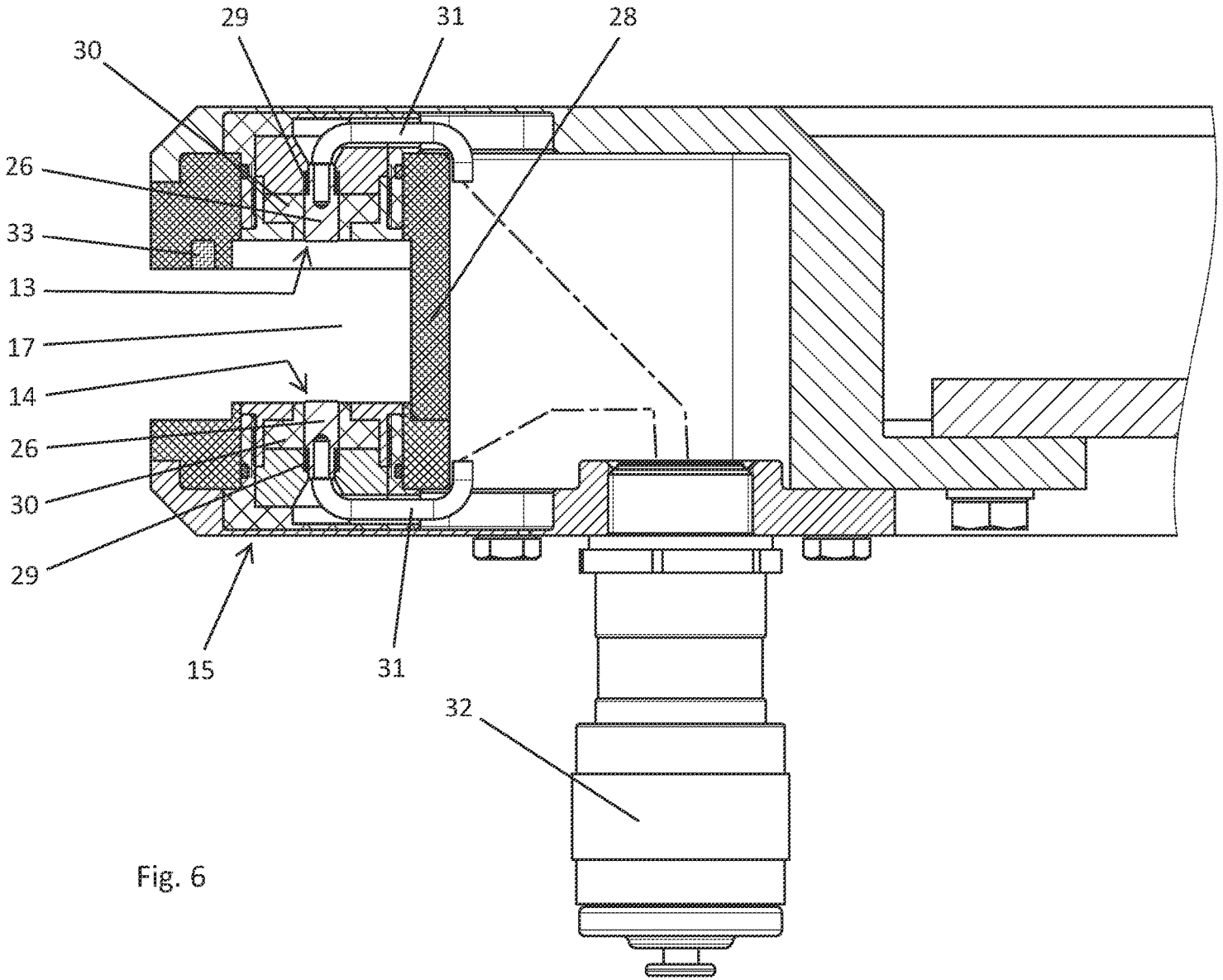

The groove 17 of the outer ring 15 is also formed by an electrical insulating body 28 in which the sliding contacts 13, 14 are embedded at a point on its circumference, as can be seen in FIG. 6. The sliding contacts 13, 14 essentially consist of pins 26 which are pressed by springs 29 towards the inside of the groove 17 and thus against the slip rings 11, 12. The pins of the sliding contacts 13, 14 are guided in ceramic sleeves 30, which serve for explosion protection, and are connected to conductors 31. The conductors 31 lead to a second plug 32, to which a line connected to the pipe handler 10 can be plugged.

Seals 33 are inserted in the insulating body 28 of the outer ring and the insulating body 24 of the inner ring 16, which seal the gaps between the outer ring 11 and the inner ring 12 that lead to the outside and lie in radial planes. As a result, the inside of the groove 17 is completely sealed in accordance with the regulations for explosion safety on drilling installations, so that any sparks that may occur between the slip rings 11, 12 and the sliding contacts 13, 14 cannot lead to explosions. In addition, due to the seals 33, dirt or rainwater cannot enter the interior of the groove 17.

The device 1 according to the invention can also be installed in a Kelly drive system, i.e. a drilling system in which the drill string is not rotated from above with a top drive 3, but in the area of the borehole with a Kelly drive. In the Kelly drive system, the device 1 according to the invention also serves to transmit data or current between a rotating part, for example the pipe handler 10, and a rotationally fixed part, for example a holder for the pipe handler 10 arranged on a movable carriage.

The device according to the invention can also be used for a workover rig. The workover rig also has a rotatable part (e.g. also a type of pipe handler 10) and a rotationally fixed part (e.g. also a top drive 3), between which data or current transmission can take place with the aid of the device 1 according to the invention.

LIST OF REFERENCE SIGNS

1 device for data and/or power transmission
2 adapter
3 top drive
4 vertical guide
5 axis of rotation
6 spur gear
7 pinion
8 drive
9 bar-shaped links
10 pipe handler
11 slip ring
12 slip ring
13 sliding contact
14 sliding contact
15 first ring, outer ring
16 second ring, inner ring
17 groove
18 holder
19 pivot arm
20 bore
21 support arm
22 axis
23 spokes
24 insulating body
25 plug
26 pins
27 conductor
28 insulating body
29 springs
30 ceramic sleeves
31 conductor
32 plug
33 seals

The invention claimed is:

1. A device for transmitting data and/or power from a rotating part to a non-rotating part of a drilling rig or a workover rig, the device comprising:

at least one slip ring with at least one sliding contact in contact therewith, a first ring and a second ring, wherein the first ring and the second ring delimit a closed area, and wherein the at least one slip ring and the sliding contact(s) are arranged within the closed area, wherein the first ring has a circumferential groove, wherein the second ring is received at least partially in the groove of the first ring, and wherein the at least one slip ring and the sliding contact(s) is/are arranged within the groove on the first ring or on the second ring, respectively.

2. The device according to claim 1, wherein the groove is open in a radial direction.

3. The device according to claim 2, wherein at least two slip rings and sliding contacts are present and are each arranged on opposite sides of the second ring.

4. The device according to claim 2, wherein there are at least two slip rings and sliding contacts arranged substantially side by side.

5. The device according to claim 1, wherein at least two slip rings and sliding contacts are present and are each arranged on opposite sides of the second ring.

6. The device according to claim 1, wherein there are at least two slip rings and sliding contacts arranged substantially side by side.

7. The device according to claim 1, wherein the at least one slip ring is/are arranged on the second ring and the sliding contact(s) is/are arranged on the first ring or wherein the at least one slip ring is/are arranged on the first ring and the sliding contact(s) is/are arranged on the second ring.

8. The device according to claim 1, wherein the groove is at least partially formed by an electrical insulating body in which the at least one slip ring or the sliding contact(s) is/are embedded.

9. The device according to claim 1, wherein the second ring comprises an insulating body which is received in the groove, and on which the at least one slip ring or the sliding contact(s) is/are arranged.

10. The device according to claim 1, wherein seals are arranged on the first and/or on the second ring, which seal the closed area between the first ring and the second ring to the outside.

11. The device according to claim 10, wherein the at least one slip ring and the sliding contact(s) are accommodated in an area of the groove located inside the seals.

12. The device according to claim 1, wherein a plug for a cable leading to the rotating part is arranged on the first ring, which plug is connected to the sliding contact(s) or the at least one slip ring.

13. The device according to claim 1, wherein a plug for a cable leading to the non-rotating part is arranged on the second ring, which plug is connected to the at least one slip ring or the sliding contact(s).

14. The device according to claim 13, wherein the second ring has a holder, a pivot arm and a support arm with which the second ring can be mounted on the non-rotating part.

15. The device according to claim 14, wherein the plug for the cable leading to the non-rotating part is arranged on the holder.

16. A top drive system of a drilling installation, in which a top drive is mounted on a vertical guide of a tower of the drilling installation in a rotationally fixed manner via a carriage and movable in the vertical direction, wherein a pipe handler is mounted on the top drive via an adapter having an axis of rotation, wherein the pipe handler is rotatable relative to the top drive about the axis of rotation, and wherein the top drive is connected to system devices or controls of the drilling installation on the surface via an electrical data and/or power line, wherein the top drive system comprises a device according to claim 1 for the transmission of electrical data and/or electrical power between the top drive and the pipe handler.

17. The top drive system according to claim 16, wherein a central axis of the first and second rings around which the outer ring rotates is offset from the axis of rotation of the adapter.

* * * * *